US009376874B2

(12) United States Patent
Reimers

(10) Patent No.: US 9,376,874 B2
(45) Date of Patent: Jun. 28, 2016

(54) PUMP POSITIONED AT A DRILL BIT

(75) Inventor: Nils Reimers, Bjoa (NO)

(73) Assignee: Tomas AS, Stavanger (NO)

( * ) Notice: Subject to any disclaimer, the term of this patent is extended or adjusted under 35 U.S.C. 154(b) by 416 days.

(21) Appl. No.: 13/809,863

(22) PCT Filed: Jul. 25, 2011

(86) PCT No.: PCT/NO2011/000213

§ 371 (c)(1),
(2), (4) Date: Feb. 4, 2013

(87) PCT Pub. No.: WO2012/018261

PCT Pub. Date: Feb. 9, 2012

(65) Prior Publication Data

US 2013/0206482 A1 Aug. 15, 2013

(30) Foreign Application Priority Data

Aug. 5, 2010 (NO) ..... 20101108

(51) Int. Cl.

| | |
|---|---|
| ***E21B 21/00*** | (2006.01) |
| ***E21B 10/60*** | (2006.01) |
| ***E21B 21/08*** | (2006.01) |
| ***E21B 21/12*** | (2006.01) |

(52) U.S. Cl.

CPC ..... *E21B 21/00* (2013.01); *E21B 10/60* (2013.01); *E21B 21/08* (2013.01); *E21B 21/12* (2013.01)

(58) Field of Classification Search

CPC ..... E21B 21/00; E21B 21/02; E21B 21/08; E21B 21/12; E21B 10/23; E21B 10/18; E21B 10/60; E21B 10/61

See application file for complete search history.

(56) References Cited

U.S. PATENT DOCUMENTS 4,515,229 A * 5/1985 Drummond ..... E21B 10/18 175/337
4,540,055 A * 9/1985 Drummond et al. ..... 175/323

(Continued)

FOREIGN PATENT DOCUMENTS

| | | | |
|---|---|---|---|
| CN | 2732976 | Y | 10/2005 |
| EP | 0 204 677 | A2 | 12/1986 |
| WO | 2008/055349 | A1 | 5/2008 |

OTHER PUBLICATIONS

International Search Report for parent application PCT/N02011/000213, having a mailing date of Nov. 24, 2011.

(Continued)

*Primary Examiner* — David Andrews
*Assistant Examiner* — Carib Oquendo
(74) *Attorney, Agent, or Firm* — Andrus Intellectual Property Law, LLP

(57) ABSTRACT

An ejector or jet pump is provided for use in the drilling of wells to prevent the total fluid pressure at the bottom of the borehole from reaching a level which constitutes a risk of cracking the rock or sediment being drilled, thus resulting in leakage and circulation failure. The pump is placed between the drill bit and the drill string and provided with nozzles directed in such a way that low pressure is established externally at the drill bit. The pump is operated by the drilling fluid which is supplied in the normal way through the drill string. The pressure difference across the pump is used to draw a secondary flow of drilling fluid from the borehole through internal bores in the pump to the nozzles in the drill bit. This fluid flow provides necessary cleaning of the drill bit and drilling surface.

7 Claims, 3 Drawing Sheets

(56) References Cited

U.S. PATENT DOCUMENTS

| | | | | |
|---|---|---|---|---|
| 5,775,443 | A | 7/1998 | Lott | |
| 5,934,389 | A * | 8/1999 | Ramsey et al. | 175/57 |
| 6,276,452 | B1 | 8/2001 | Davis et al. | |

OTHER PUBLICATIONS

Written Opinion for parent application PCT/NO2011/000213, having a mailing date of Nov. 24, 2011.

* cited by examiner

PUMP POSITIONED AT A DRILL BIT

CROSS-REFERENCE TO RELATED APPLICATIONS

This application is the U.S. national stage application of International Application No. PCT/NO2011/000213, filed Jul. 25, 2011, which International application was published on Feb. 9, 2012 as International Publication No. WO 2012/018261 A1 in the English language, and which application is incorporated herein by reference. The International application claims priority of Norwegian Patent Application No. 20101108, filed Aug. 5, 2010, which application is incorporated herein by reference.

BACKGROUND

This invention relates to a pump positioned at a drill bit. It relates, more particularly, to a pump which aim it is to clean the drill bit and at the same time limit the fluid pressure that is acting against the abutment surface and that may cause leakage of drilling fluid into the rock during the drilling of wells, for example such as those drilled for the exploration and production of oil or gas.

During the drilling of wells in the underground, ripped rock, usually called cuttings, is washed away and up from the drilling surface by means of drilling fluid which is pumped down inside the drill string and flushed out through nozzles in the drill bit in order then to flow up the annulus formed between the drill string and the established borehole. In addition to the hole cleaning which is described above, through its adapted specific weight, the drilling fluid is to hold back inflow from possible pressurized layers in the underground. However, the specific weight of the drilling fluid together with the reactive circulation pressure acting against the drilling surface must not exceed such a value that the drilling fluid leaks into, or even breaks open, fractures in the rock that is being drilled. If such leakages should occur, the drilling fluid will disappear and lead to circulation failure with subsequent impaired hole cleaning and risk of inflow from pressurized layers.

It is not unusual for geological layers and pressures in the underground to be such that it is necessary to drill with specific weights and circulation rates that give a total fluid pressure relatively close to a value that could be sufficient to break up the rock. The risk of breaking open fractures is usually greatest at the drilling surface where new rock is being exposed and where the hydrostatic pressure column together with the reactive circulation pressure is at its highest. At the same time, more unpredictable pressure components from turbulence and high velocities are also acting in this surface. An optimum solution to reduce the risk of forcing open fractures has such properties that it limits the total fluid pressure against the drilling surface to a value equal to the fluid pressure that is acting in the established borehole. In this way, the fluid pressure against new rock or sediment will not exceed a level approximately equal to the one that has been found bearable so far in the drilling process and that, by means of known techniques, may be read continuously through transponders and telemetry.

In U.S. Pat. No. 5,775,443 and the corresponding WO application 2008/055349 an ejector pump to be built into a drill bit for the purpose of improving the cleaning of a drill bit is described. The purpose is achieved by directing a side flow from the internal bore of the drill string to ejector pumps placed externally on the drill bit whereas the main flow is carried to the ordinary nozzles of the drill bit. Thus, by passing drilling fluid at high pressure through the nozzles of the drill bit in the ordinary way, no restriction is established in the pressure acting against the drilling surface, and thereby the solution has no effect in relation to limiting the fluid pressure against the drilling surface. Further, the solution has the considerable drawback of being integrated in the drill bit and not being connected to the drill bit through a standard coupling. The range of drill bits is thereby restricted, which is critical in relation to the value of being able to select a drill bit on the basis of acquired local experience and change the type of drill bit according to changes in the nature of the rock.

SUMMARY

The invention has for its object to remedy or reduce at least one of the drawbacks of the prior art.

The object is achieved in accordance with the invention through the features which are specified in the description below and in the claims that follow.

A pump is provided, which is positioned at a drill bit connected to a drill string of the kind that is common for drilling a borehole in the underground for the production of oil and gas, for example, the pump being characterized by the entire fluid flow of the drill string being carried to at least one ejector nozzle which has its outlet directed away from the drill bit in an annulus between the drill string and the borehole, and at least one bore extending between the annulus on the outlet side of the ejector nozzle to the nozzles of the drill bit.

Thus, a very good solution is achieved in that an element with the properties of an ejector or jet pump may be arranged between a commonly applied drill bit and drill string. The characteristic of the invention is achieved by directing the entire flow of drilling fluid from the drill string through the ejector nozzles which may be positioned in suitable cut-outs in the longitudinal direction externally around the unit, the nozzles being directed backwards towards the established borehole, so that high pressure from the drill string does not act against the drilling surface but, on the contrary, brings about a pressure drop at the drill bit.

The invention is further characterized by open internal bores being arranged, directing fluid from the annulus in the established borehole through the drill bit to the low-pressure side of the ejector pump. Thus, the pump drives a continuous circulation of drilling fluid over the drill bit and drilling surface, providing the necessary cleaning. With this, the central distinctive character of the invention is achieved also by the pressure out of the drill bit, and thereby on the drilling surface, which cannot exceed the pressure in the annulus, the established borehole, that is. This is in contrast to the prior art, in which the high-energy flow from the drill string is directed directly against the drilling surface and in which the pressure may reach values that are considerably higher than those sufficient for breaking open fractures in the rock.

By said high-energy fluid flow from the drill string being carried in its entirety through the ejector nozzles, the pump will have high capacity. On the other hand, the drilling fluid drawn by the pump through the bores from the annulus and through the drill bit will have few restrictions, and thereby such a high-volume and low-pressure flow that is optimal for hole cleaning is achieved.

Therefore, by the described operation, the invention will both limit the pressure on the drilling surface and ensure sufficient hole cleaning. As exemplification it may be imagined that a space between two cutting elements becomes clogged by cuttings. In such a situation, the pressure against the drilling surface would not rise beyond a feed pressure taken from the annulus while an underpressure is created downstream of the clogging, so that the fluid rate adjacent to the clogging increases, causing erosion and dissolving of the clogging. This manner of operation for cleaning possesses considerable advantages in relation to flushing and is a technique known from vacuum cleaners and mud suction dredgers among other things. Ejector pumps are also prior art in connection with the cleaning of oil and gas wells.

A bore extending between the pipe bore of the drill string and the ejector nozzle, and also the bore of the drill bit, may be arranged with valves allowing alternative flow directions and restrictions.

The pump may be integrated in drilling equipment which, additionally, has other known functions. Other drilling equipment, too, may be arranged between the pump and the drill bit.

The ejector nozzles may be placed in cut-outs extending entirely or partially inside a main unit.

Accordingly, in both application and embodiment, the invention has advantages and characteristics that make it substantially different from the prior art.

BRIEF DESCRIPTION OF THE DRAWINGS

In the following, an example of a preferred embodiment is described, which is visualized in the accompanying drawings, in which.

DETAILED DESCRIPTION OF THE DRAWINGS

Figure 1:
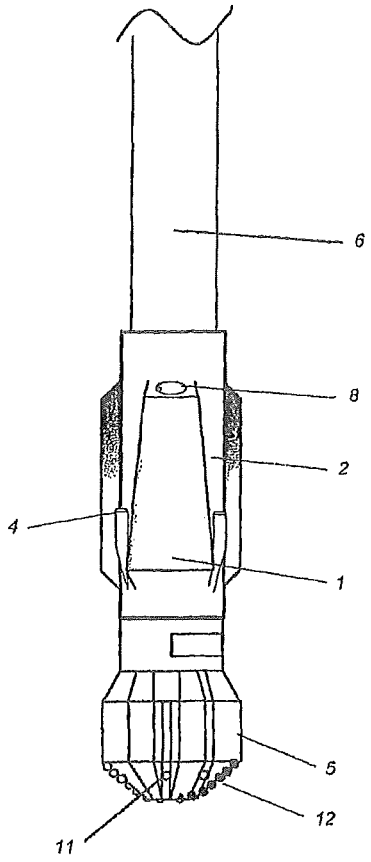
FIG. 1 shows a pump in accordance with the invention placed between a drill bit and a drill string.

In the drawings the reference numeral 1 indicates a main element 1 in the form of an elongated cylindrical part arranged between a drill bit 5 and a drill string 6. The main element 1 is provided with external cut-outs 2 in the circumference of the element 1 oriented in the longitudinal direction of the element. Nozzles 4 are placed centrally in the cut-outs 2 so that the cut-outs 2 together with the nozzles 4 work as ejector or jet pumps having their low-pressure side or suction side at the drill bit 5. At the opposite end of the main element 1, the drill string 6 is connected. The main element or the pump has internal bores 7 directing the fluid flow 3 from the drill string 6 to the ejector nozzles 4. Further, the main element 1 has additional separate bores 8 leading from the annulus 15 on the pressure or outlet side of the main element 1 to the connecting point 9 for the drill bit 5. When fluid jets out of the nozzles 4, a pressure difference arises across the main element 1, so that fluid will flow from the annulus 15 on the pressure side and through the bores 8 to the drill bit 5 and further out through the ordinary nozzles 11 of the drill bit 5 to the low-pressure side of the main unit 1 for the purpose of keeping the cutting elements 12 of the drill bit 5 and the drilling surface 13 clean.

In FIG. 1 the main element 1 is shown to be placed between a drill bit 5 and a drill string 6. Further, the cut-outs 2 in the longitudinal direction externally along the main element 1, and the ejector nozzles 4 that are placed in the cut-outs 2 so that a jet pump effect is achieved are shown. In this connection, the main element 1 is connected to the drill bit 5 by threaded connections of such a type that is standard for drilling equipment, so that between the drill bit 5 and the main element 1, other necessary drilling equipment, such as systems for directional control, measuring and stabilization, for example, may be arranged whenever required.

Figure 2:
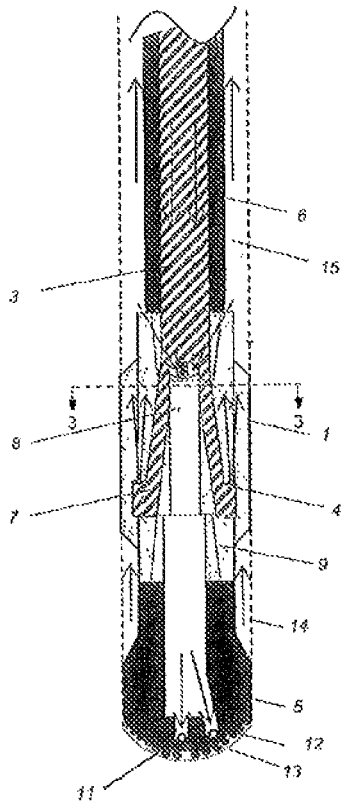
FIG. 2 shows a longitudinal section with internal cut-outs and indications of flow directions.

In FIG. 2, a longitudinal section of the main element 1 with the bores 7 directing the fluid flow from the drill string 6 internally to the ejector nozzles 4 is shown. Further, the separate bores 8 extending from the main element 1 externally at the annulus 15 around the drill string 6 and leading to the drill bit 5 and further out through the nozzles 11 are shown. In connection with the bores 7 and 8, it is conceivable to have valves arranged, allowing remote-controlled opening and closing, so that the pump may be started and stopped, or adjusted according to conditions and needs.

Figure 3:
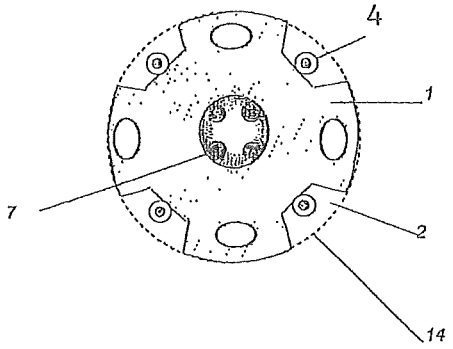
FIG. 3 shows a cross section of the pump taken on line 3-3 of FIG. 2 with cut-outs placed along the circumference of the pump.

In FIG. 3, a cross section through the main element 1 with cut-outs 2 and ejector nozzles 4 placed around the circumference of the main element corresponding externally to the diameter 14 of the borehole is shown. It is also conceivable to place the ejector nozzles 4 and cut-outs 2 inside, or partly inside, the main element 1.

The invention claimed is:

1. A pump apparatus comprising a pump positioned at a drill bit connected to a drill string having a pipe bore for receiving fluid flow wherein at least one ejector nozzle has an outlet directed away from the drill bit in an annulus between the drill string and a borehole, at least one first bore separate and spaced from the at least one ejector nozzle and the pipe bore extends between the annulus at the outlet of the at least one ejector nozzle and a set of nozzles on the drill bit, and at least one second bore separate and spaced from the at least one first bore extends between the pipe bore and the at least one ejector nozzle, the pump being configured to define a flow path directing an entire fluid flow through the pipe bore of the drill string and through the at least one second bore to the at least one ejector nozzle into the annulus and then through the at least one first bore for delivery to the set of nozzles.

2. The apparatus in accordance with claim 1, wherein the at least one second bore and the at least one first bore are adapted to be arranged with valves allowing alternative flow directions and restrictions.

3. The apparatus in accordance with claim 1, wherein the pump is integrated in drilling equipment.

4. The apparatus in accordance with claim 1, wherein there is other drilling equipment adapted to be formed as systems for directional control, measuring and stabilization arranged between the pump and the drill bit.

5. The apparatus in accordance with claim 1, wherein the at least one ejector nozzle includes ejector nozzles that are placed in cut-outs located inside or outside a main element arranged between the drill bit and the drill string.

6. The apparatus in accordance with claim 1, wherein the pump is configured such that the entire fluid flow through the drill string jets out of the at least one ejector nozzle into the annulus creating a pressure difference in the pump so that the fluid flow is drawn into the at least one first bore and delivered to the set of nozzles.

7. The apparatus in accordance with claim 6, wherein the pump is further configured such that the entire fluid flow through the drill string and the at least one ejector nozzle is directed away from the drill bit towards an inlet end of the at least one first bore to prevent fluid pressure on a drilling surface at a bottom of the borehole from causing cracking of the drilling surface, and, at the same time, the fluid flow delivered to the set of nozzles cleans the drilling surface and the drill bit.

* * * * *